United States Patent [19]

Watanabe

[11] 4,099,115

[45] Jul. 4, 1978

[54] CONSTANT-VOLTAGE REGULATED POWER SUPPLY

[75] Inventor: Sakuji Watanabe, Yono, Japan

[73] Assignee: Nippon Kogaku K.K., Tokyo, Japan

[21] Appl. No.: 707,618

[22] Filed: Jul. 22, 1976

[30] Foreign Application Priority Data

Jul. 28, 1975 [JP] Japan ..... 50-91160
Sep. 5, 1975 [JP] Japan ..... 50-107098

[51] Int. Cl.[2] ..... G05F 3/08; G01R 19/16

[52] U.S. Cl. ..... 323/19; 323/68; 340/636; 354/60 R

[58] Field of Search ..... 73/362 SC; 307/310; 320/35; 323/1, 8, 16, 19, 22 T, 68, 69; 324/29.5; 340/249; 354/24, 29, 30, 50, 51, 60 R, 60 E, 60 L

[56] References Cited

U.S. PATENT DOCUMENTS

| | | | |
|---|---|---|---|
| 3,828,240 | 8/1974 | Keller et al. | 323/22 T |
| 3,887,863 | 6/1975 | Brokaw | 323/19 |
| 3,896,456 | 7/1975 | Toyoda | 354/51 X |
| 3,914,683 | 10/1975 | Plassche | 323/1 |
| 3,970,933 | 7/1976 | Hamaguchi et al. | 340/249 X |
| 3,975,747 | 8/1976 | Toyoda | 354/60 E |
| 4,007,415 | 2/1977 | Toyoda | 323/19 |

*Primary Examiner*—A. D. Pellinen
*Attorney, Agent, or Firm*—Shapiro and Shapiro

[57] ABSTRACT

The temperature-dependent characteristics of a constant-voltage regulated power supply are determined by combining output voltages of a pair of circuits that have positive and negative temperature-dependent characteristics, respectively. One of the circuits includes an operational amplifier having resistors and diodes connected to its input terminals so as to provide a voltage having a positive temperature-dependent characteristic. The other circuit includes a diode or a transistor connected to the output of the operational amplifier for providing a voltage having a negative temperature-dependent characteristic. By adjusting the resistor values, the temperature-dependence, or lack of temperature-dependence, of the combined output voltage can be controlled.

11 Claims, 5 Drawing Figures

CONSTANT-VOLTAGE REGULATED POWER SUPPLY

BACKGROUND OF THE INVENTION

1. Field of the Invention

This invention relates to a constant-voltage regulated power supply circuit of high accuracy which uses an operational amplifier.

2. Description of the Prior Art

Most electronic equipment has heretofore required temperature compensation in order to ensure that the electric circuits used therein perform normal functions regardless of any temperature variation.

Such temperature compensation has heretofore been accomplished by utilizing the fact that the forward voltage drops across diodes or the base-emitter voltages of transistors exhibit temperature dependent characteristics. However, these characteristics exhibit only a predetermined value, and therefore, temperature compensation, if possible at all, has not provided satisfactory accuracy.

For this reason, there has been a desire for a constant-voltage regulated power supply circuit which has temperature dependent characteristics that can be varied as desired, which is simple in construction and yet high in accuracy.

SUMMARY OF THE INVENTION

It is a first object of the present invention to provide a constant-voltage regulated power supply circuit having temperature dependent characteristics which may be selected as desired, including the avoidance of temperature dependence.

It is a second object of the present invention to provide a constant-voltage regulated power supply circuit which is simple in construction and yet high in accuracy.

It is a third object of the present invention to provide a constant-voltage regulated power supply circuit which has temperature dependent characteristics that may be selected as desired through the simple operation of varying resistance values.

These objects and other features of the present invention will become more fully apparent from the following detailed description of several embodiments of the invention, taken in conjunction with the accompanying drawings.

DESCRIPTION OF THE PREFERRED EMBODIMENTS

Figure 1:
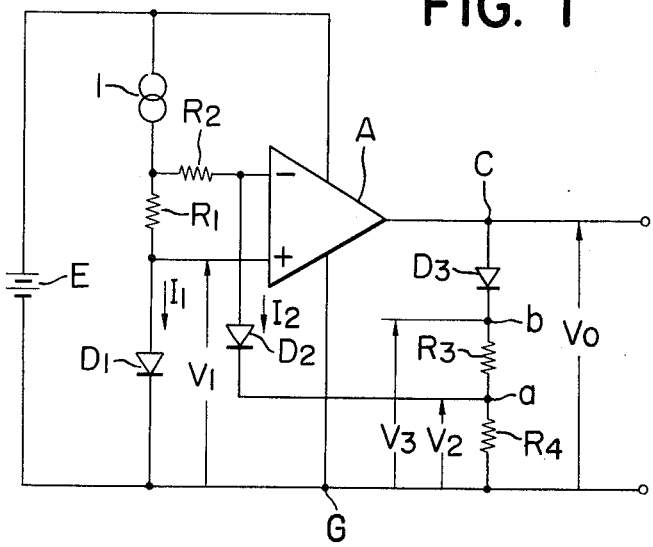
FIG. 1 is a diagram of the constant-voltage circuit of variable temperature dependent characteristics according to a first embodiment of the present invention.

Referring to FIG. 1 which shows an embodiment of the present invention, a constant-current source 1, a resistor $R_1$ and a diode $D_1$ are connected together in series across a power supply battery E. The junction between the constant-current source 1 and the resistor $R_1$ is connected to the inverting input terminal of an operational amplifier A by a resistor $R_2$, and the junction between the resistor $R_1$ and the diode $D_1$ is connected to the non-inverting input terminal of the operational amplifier A. Connected in series between the output terminal C of the operational amplifier A and the negative terminal of the power supply battery E, namely, the common terminal G, are a diode $D_3$, a resistor $R_3$ and a resistor $R_4$. A feedback diode $D_2$ is connected between junction *a* of resistors $R_3$ and $R_4$ and the inverting input terminal of the operational amplifier A. The junction between resistor $R_3$ and diode $D_3$ is designated at *b*. The operation of the circuit will not vary essentially even if constant-current source 1 is replaced by a resistor. This will also hold true even if the junction between resistors $R_1$ and $R_2$ is connected to the positive terminal of the power supply battery E.

The operational amplifier A, resistors $R_1$, $R_2$, diodes $D_1$, $D_2$ and constant-current source 1 together constitute a first circuit. At junction *a* between resistors $R_3$ and $R_4$, which is the output of the first circuit, there is a voltage $V_2$ having a positive temperature dependent characteristic.

Diode $D_3$ constitutes a second circuit. The voltage across diode $D_3$ has a negative temperature dependent characteristic, as will later be described, and thus the potential at junction *b* with respect to the output terminal C of the operational amplifier A has a negative temperature dependent characteristic.

Resistors $R_3$ and $R_4$ together constitute a third circuit.

Operation of the present embodiment will now be described.

Assuming that the amplification factor of the operational amplifier A is sufficiently great, the potential at the inverting input terminal thereof and the potential at the non-inverting input terminal thereof are considered to be equal. In such a case, it follows that $$I_1 \cdot R_1 = I_2 \cdot R_2 \tag{1}$$

where $I_1$ represents the current flowing through resistor $R_1$ and diode $D_1$, and $I_2$ the current flowing through resistor $R_2$ and diode $D_2$. Also, the potential $V_1$ at the non-inverting input terminal of operational amplifier A is equal to the voltage drop across diode $D_1$ caused by the constant current $I_1$. Generally, the current-voltage relationship of a logarithmic conversion element such as a diode or the like is expressed as:

$$V_D = \frac{k \cdot T}{q} \ln \frac{I_D}{I_S} \tag{2}$$

where $V_D$ represents the forward voltage drop of the diode, *k* the Boltzman constant, T the absolute temperature, *q* the charge of an electron, $I_D$ the current flowing through the diode, and $I_S$ the backward saturation current in the diode. Hence, $V_1$ is given by:

$$V_1 = \frac{k \cdot T}{q} \ln \frac{I_1}{I_s} \quad (3)$$

It is evident that the voltage $V_2$ at junction *a* has a value equal to the voltage $V_1$ minus the voltage drop across diode $D_2$ due to current $I_2$. Hence, $V_2$ is given by:

$$V_2 = V_1 - \frac{k \cdot T}{q} \ln \frac{I_2}{I_s} = \frac{k \cdot T}{q} \ln \frac{I_1}{I_2} \quad (4)$$

With equation (1) taken into consideration, the expression for $V_2$ may be rewritten as:

$$V_2 = \frac{k \cdot T}{q} \ln \frac{R_2}{R_1} \quad (5)$$

Thus, it will be seen that voltage $V_2$ appearing at junction *a*, which is the output of the first circuit, is determined only by resistors $R_1$ and $R_2$, and not only is it independent of the source voltage, but it also has a positive temperature dependent characteristic proportional to the absolute temperature.

In addition, the current $I_2$ is very small relative to the current flowing through resistor $R_3$. Therefore, the voltage drop across resistor $R_4$ due to current $I_2$ is negligible. Hence, voltage $V_3$ at junction *b* is given by:

$$V_3 = \frac{R_3 + R_4}{R_4} \cdot V_2 = \frac{k \cdot T}{q} \cdot \frac{R_3 + R_4}{R_4} \cdot \ln \left(\frac{I_1}{I_2}\right) \quad (6)$$

When equation (1) is introduced into equation (6), voltage $V_3$ can be expressed as:

$$V_3 = \left\{ \frac{k}{q} \cdot \frac{R_3 + R_4}{R_4} \cdot \ln \frac{R_2}{R_1} \right\} T \quad (7)$$

From the foregoing, it is evident that voltage $V_3$ at junction *b* is determined only by resistors $R_1$, $R_2$, $R_3$ and $R_4$, and not only is it independent of the source voltage, but it also has a positive temperature dependent characteristic proportional to the absolute temperature.

Now, it is well-known that the forward voltage across a diode has a negative temperature dependent characteristic of the order of −2.2 (mV/° C), and thus, the voltage $V_o$ at the output C is the sum of voltage $V_3$ at junction *b*, which has a positive temperature dependence, and the voltage across diode $D_3$, which has a negative temperature dependence.

For example, in the embodiment of FIG. 1, consideration will be given to the case where, with 20° C as the reference temperature, voltage $V_o$ at the output C is maintained at a predetermined level unaffected by temperature variation.

As will clearly be seen from the equation (7), which gives voltage $V_3$ at junction *b*, the factor $$\frac{k}{q} \cdot \frac{R_3 + R_4}{R_4} \cdot \ln \left(\frac{R_2}{R_1}\right)$$

is the constant of proportionality for the absolute temperature T.

Therefore, by preselecting the values of the various resistors so that the proportionality constant is equal to 2.2 (mV), it will be ensured that voltage $V_o$ at the output C is maintained at a predetermined value equal to (273 + 20) × 2.2 = 645(mV) plus the potential drop across diode $D_3$ at 20° C. Further, by suitably determining the relation between the various elements, voltage $V_o$ at the output C can be made to assume any desired constant voltage without any temperature dependence.

Also, by selecting appropriate values for the resistors $R_1$, $R_2$, $R_3$ and $R_4$, voltage $V_o$ at the output may be chosen so that it has either a positive or a negative temperature dependence.

A similar effect may also be provided by connecting one or more diodes in parallel with diode $D_2$.

Although the present embodiment employs resistors $R_3$ and $R_4$, the use of resistor $R_3$ is not essential, as seen from the equation (7). In other words, resistor $R_3$ may be short-circuited (replaced by a conductor). However, the use of resistors $R_3$ and $R_4$ will facilitate the adjustment of the proportionality constant of the absolute temperature T.

Figure 2:
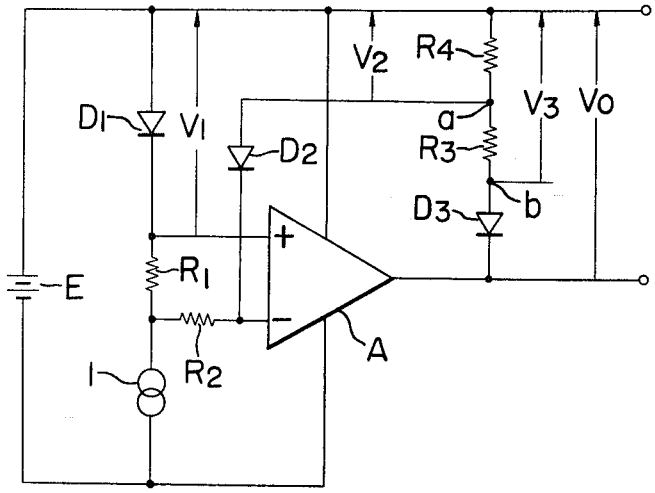
FIG. 2 is a diagram of the constant-voltage circuit of variable temperature dependent characteristics according to a second embodiment of the present invention.

FIG. 2 shows a second embodiment of the present invention in which the connection of the diodes to the two input terminals of the operational amplifier A is opposite to that in FIG. 1. The circuit elements which are functionally indentical to those in the first embodiment are given similar reference characters, and the voltage values having the same suffix numbers are equal. Details of the operation are similar to those of the first embodiment and need not be described.

Figure 3:
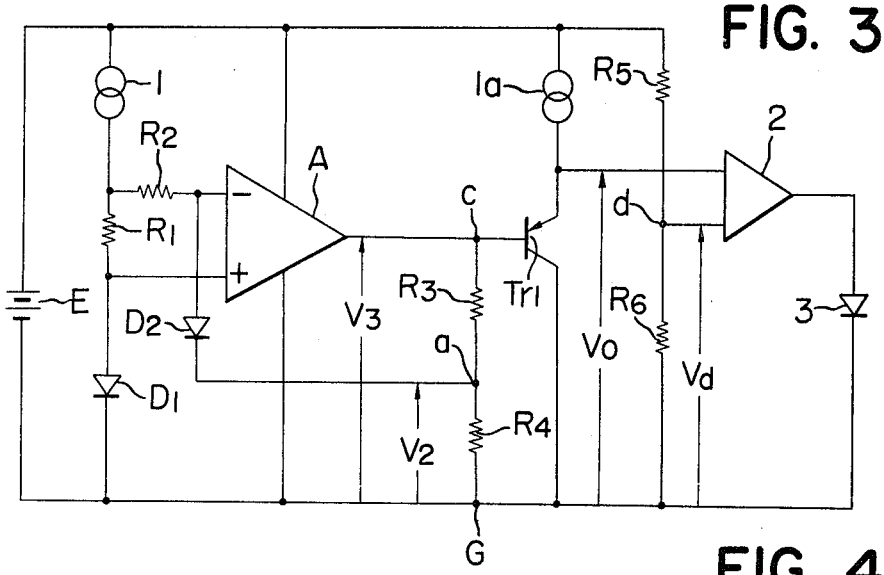
FIG. 3 is a diagram of the constant-voltage circuit of variable temperature dependent characteristics according to a third embodiment of the present invention, as applied to a source voltage checker circuit.

FIG. 3 is a circuit diagram showing a third embodiment of the present invention as applied to a voltage checker circuit.

Resistors $R_3$ and $R_4$ are connected in series between the output terminal C of the operational amplifier A and the common terminal G. The output voltage $V_2$ of the first circuit is applied to junction *a* between resistors $R_3$ and $R_4$. A constant-current source 1*a* and a transistor $Tr_1$ are connected in series between the opposite terminals of the power supply battery E, and the output terminal C of the operational amplifier A is connected to the base terminal of the transistor $Tr_1$.

The transistor $Tr_1$ is used in place of diode $D_3$ of the first embodiment. Voltage $V_2$ at junction *a*, which is the output of the first circuit, is expressed by equation (5) and is proportional to the absolute temperature T as was described in detail with respect to the first embodiment. Therefore, voltage $V_3$ at the output terminal C of the operational amplifier is given by $$\left\{ \frac{k}{q} \cdot \frac{R_3 + R_4}{R_4} \cdot \ln \frac{R_2}{R_1} \right\} \cdot T$$

as in equation (7) and is thus proportional to the absolute temperature T. Since the base-emitter voltage $V_{BE}$ of the transistor $Tr_1$ has a negative temperature dependence, the emitter voltage $V_o$ of the transistor is the sum of voltage $V_3$, which has a positive temperature dependence and voltage $V_{BE}$, which has a negative temperature dependence. Hence, as was previously described in connection with the first embodiment, emitter voltage $V_o$ of transistor $Tr_1$ may be selected to have no temperature dependence by choosing appropriate values for resistors $R_1$, $R_2$, $R_3$ and $R_4$.

Voltage dividing resistors $R_5$ and $R_6$ are connected in series between the opposite terminals of the power supply battery E. Thus, the voltage Vd appearing at the junction $d$ between these resistors decreases with a decrease in the source voltage.

A comparator circuit 2 has one input terminal connected to the emitter terminal of transistor $Tr_1$ and the other input terminal thereof connected to junction $d$ between the voltage dividing resistors $R_5$ and $R_6$. A light-emitting diode 3 is connected between the output terminal of comparator circuit 2 and the common terminal G.

Thus, input voltages $V_o$ and Vd of the comparator circuit 2 are equal when the source voltage is at a certain level, and $V_o$ is lower than Vd when the source voltage is above said level, but higher than Vd when the source voltage is below said level. Therefore, comparator circuit 2 turns the light-emitting diode 3 on or off depending on the magnitude of voltage $Vd$ with respect to voltage $V_o$, thereby indicating the condition of the source voltage.

In the first, second and third embodiments so far described, in order to give the output voltage a desired temperature dependence, the values of the resistors $R_1$, $R_2$, $R_3$ and $R_4$ are varied or a plurality of diodes are connected in parallel with diode $D_2$, thereby varying the output of the first circuit having the positive temperature dependence.

According to the present invention, however, it is also possible to vary the output of the second circuit having the negative temperature dependent characteristic in order to provide a voltage $V_o$ which may have any desired temperature dependence. This will be described by reference to a fourth embodiment.

Figure 4:
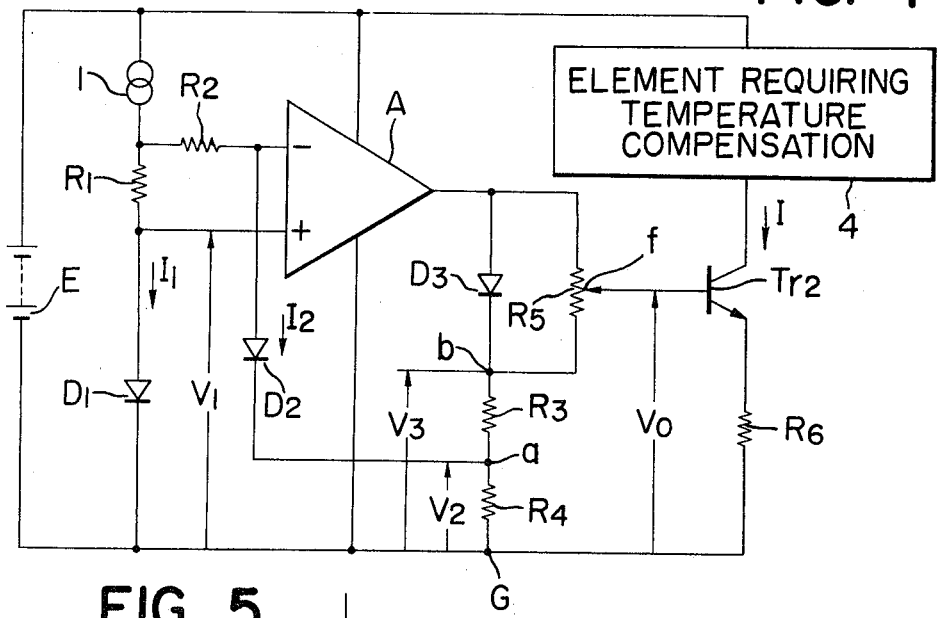
FIG. 4 is a diagram of the constant-voltage circuit of variable temperature dependent characteristics according to a fourth embodiment of the present invention, as applied to a temperature compensation circuit.

FIG. 4 shows the fourth embodiment of the present invention as applied to the temperature compensation circuit for a light-emitting diode.

In the fourth embodiment, which has a variable temperature dependent characteristic, a voltage dividing resistor $R_5$ is connected in parallel with diode $D_3$ of the circuit in FIG. 1, and output voltage $V_o$ is derived from the voltage dividing point $f$ of that resistor.

With such an arrangement, the temperature dependence of voltage $V_o$ at the voltage dividing point $f$ is varied depending upon the voltage division ratio $\rho$ of voltage dividing resistor $R_5$.

Figure 5:
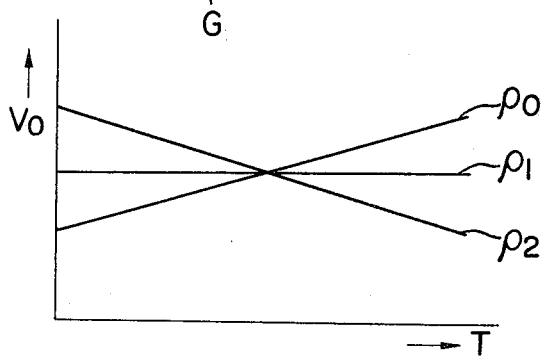
FIG. 5 is a graph illustrating the temperature dependence as a function of the value of the voltage division ratio $\rho$ of the fourth embodiment.

Reference will now be made to FIG. 5 in order to explain the relationship between the voltage division ratio $\rho$ of the voltage dividing resistor $R_5$ and the temperature dependence of voltage $V_o$.

When the voltage division ratio $\rho$ of the voltage divider $R_5$ is zero (see parameter $\rho_o$ in FIG. 5), voltage $V_o$ at the voltage dividing point $f$ is equal to voltage $V_3$ at junction $b$, and it has a positive temperature dependence. As the voltage dividing ratio $\rho$ is gradually increased, the voltage across diode $D_3$, which has a negative temperature dependence, is added to voltage $V_3$, which has a positive temperature dependence. Therefore, at a certain voltage division ratio $\rho_1$, the positive and the negative temperature dependent characteristics offset each other so that voltage $V_o$ at the voltage dividing point $f$ has no temperature dependence (see parameter $\rho_1$ in FIG. 5).

By further increasing the voltage division ratio, voltage $V_o$ may be given a negative temperature dependence (see parameter $\rho_2$ in FIG. 5).

As shown in FIG. 4, an element 4 requiring temperature compensation may be connected between the collector of a transistor $Tr_2$ and the positive terminal of the power supply battery E. The emitter of this transistor is connected to the negative terminal of the power supply battery E (common terminal G) through a resistor $R_6$. Voltage $V_o$ at the voltage dividing point $f$ of voltage dividing resistor $R_5$ is applied to the base of the transistor $Tr_2$.

Assume, for example, that the temperature-compensated element 4 is a light-emitting diode; the intensity of light emitted therefrom decreases in response to a temperature rise. In this case, if the current I flowing through the light-emitting diode is increased as the temperature rises, the intensity of light emitted from the diode will be maintained constant irrespective of the temperature variation. This can be accomplished by reducing the voltage division ratio $\rho$ of voltage dividing resistor $R_5$ and setting it so that voltage $V_o$ at the voltage dividing point $f$ has a positive temperature dependence. The collector current I of the transistor $Tr_2$ is thus increased in response to a temperature rise and ensures that the light-emitting diode 4 emits light of constant intensity irrespective of any temperature rise.

Thus, the present invention, if used as a circuit wherein the output has a positive temperature dependence, will be useful as an accurate temperature compensation circuit for a light-emitting diode wherein intensity of light emitted therefrom decreases with increasing temperature. The present invention is particularly effective as a compensation circuit used with cameras or the like.

In FIG. 4, it will be noted that a plurality of diodes connected in series, if employed instead of the diode $D_3$, will be effective when it is desired to provide a wide range of negative temperature characteristics.

According to the present invention, as will be appreciated, there is provided a constant-voltage regulated power supply circuit of high accuracy which is simple in construction wherein the temperature dependence may be varied as desired, even to provide no temperature dependence, by a simple operation of varying resistance values.

I claim:

1. A voltage generating circuit comprising:

(1) a first circuit for providing a temperature dependent output voltage, said first circuit including:

(A) an operational amplifier having first and second input terminals and an output terminal;

(B) first resistance means having one end connected to said first input terminal of said operational amplifier;

(C) second resistance means having one end connected to said second input terminal of said operational amplifier and the other end thereof connected to the other end of said first resistance means; and (D) first and second logarithmic conversion means for generating a temperature dependent voltage proportional to the logarithm of the current flowing therethrough;

said first logarithmic conversion means being connected between said second input terminal of said operational amplifier and a common terminal of said voltage generating circuit;

said second logarithmic conversion means being connected between said first input terminal of said operational amplifier and said output terminal of said operational amplifier;

(2) a second circuit connected to the output terminal of said operational amplifier for providing a temperature dependent output voltage, said voltage having a temperature dependence opposite to that of said voltage provided by said first circuit; and (3) a third circuit connected to both said first and said second circuits to combine the output voltages of said first and second circuits.

2. A circuit as defined in claim 1, wherein the output voltages of said first and second circuits are proportional to temperature.

3. A circuit as defined in claim 1, wherein said third circuit causes the temperature dependent characteristics of said first and second circuits to offset each other and provides a voltage having no temperature dependence.

4. A circuit as defined in claim 2, wherein said third circuit has resistance means for controlling the proportionality constant of the temperature dependence for at least one of said first and second circuits.

5. A circuit as defined in claim 4, wherein said first and second logarithmic conversion means comprise a first and a second diode, respectively.

6. A circuit as defined in claim 5, wherein said second circuit includes a third diode having a first end connected to said output terminal of said operational amplifier, and a second end connected to one end of said second diode, the other end of said second diode being connected to said first input of said operational amplifier.

7. A circuit as defined in claim 6, wherein said resistance means comprises a voltage dividing resistor having one end connected to said second end of said third diode and the other end thereof connected to the common terminal of said voltage generating circuit, the voltage dividing terminal of said resistor being connected to said one end of said second diode.

8. A circuit as defined in claim 6, wherein said resistance means includes a voltage dividing resistor connected to said third diode, the voltage dividing terminal of said resistor providing the output terminal of said voltage generating circuit.

9. A circuit as defined in claim 5, wherein said second circuit includes a transistor, the base-emitter voltage of which provides the temperature dependent output voltage of said second circuit and said third circuit connects the base of said transistor to the output terminal of said operational amplifier.

10. A circuit as defined in claim 2, wherein the output resulting from the outputs of said first and second circuits combined by said third circuit has a positive temperature dependence.

11. A circuit as defined in claim 10, further comprising:

a transistor to the base terminal of which is applied said combined output; and a light-emitting diode connected to the collector terminal of said transistor;

whereby the collector current of said transistor may have a positive temperature dependence so that the intensity of light emitted by said light-emitting diode, which has a negative temperature dependence, may be maintained constant irrespective of temperature variation.

* * * * *